US008419601B2

(12) United States Patent
Harrington

(10) Patent No.: US 8,419,601 B2
(45) Date of Patent: Apr. 16, 2013

(54) PEEL-OFF LABEL AREA ON PACKAGING STOCK

(75) Inventor: Steven Jay Harrington, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 367 days.

(21) Appl. No.: 12/835,479

(22) Filed: Jul. 13, 2010

(65) Prior Publication Data

US 2012/0015789 A1 Jan. 19, 2012

(51) Int. Cl.
*B31B 1/88* (2006.01)

(52) U.S. Cl.
USPC ..... 493/53; 493/55

(58) Field of Classification Search ..... 53/456; 493/53, 55
See application file for complete search history.

(56) References Cited

U.S. PATENT DOCUMENTS

| | | | | |
|---|---|---|---|---|
| 3,380,648 | A * | 4/1968 | De Lyra | 229/71 |
| 7,983,792 | B2 * | 7/2011 | Gombert et al. | 700/233 |
| 2007/0131751 | A1 * | 6/2007 | Rutledge | 229/148 |
| 2011/0186619 | A1 * | 8/2011 | Moresi | 229/71 |

* cited by examiner

*Primary Examiner* — Hemant M Desai
(74) *Attorney, Agent, or Firm* — Fox Rothschild LLP

(57) ABSTRACT

A method and system for producing a personalized dimensional document having a packaging label may include receiving, at a printing device, a dimensional document configured to be assembled into a three-dimensional package. A personalized object may be determined and printed on the dimensional document. Similarly, a packaging label may be printed, the packaging label including addressing information for a recipient of the dimensional document. The packaging label may be removably affixed to the dimensional document.

20 Claims, 5 Drawing Sheets

PEEL-OFF LABEL AREA ON PACKAGING STOCK

BACKGROUND

The disclosed embodiments relate generally to methods and systems for creating personalized printed objects having an associated packaging label.

Printing systems are no longer limited to devices that print text and images on two-dimensional substrates. Greeting cards, pop-up books, and packages are examples of printed substrates that can move from a flat structure to a three-dimensional structure through manipulation of folds, creases, cuts and perforations. It is desirable that printing systems include or collaborate with variable structural data generating and finishing systems so that together they can print text and images on a substrate and also perform structural functions such as cutting, perforating, or scoring for folds so that the resulting substrate can be manipulated into a three-dimensional structure.

FIG. 1 illustrates an exemplary dimensional document 100 before it is folded into a three-dimensional structure. The substrate may have various facets F1-F13 of varying shapes and sizes. The facets may be separated by fold lines 110 that may be created by scoring or ablating the substrate. The substrate shown may be folded into a three-dimensional box having a top facet F4; a bottom facet F10; side facets F1, F5, F7 and F11; and various flaps F2, F3, F6, F8, F9, F12 and F13. Any of the facets may be printed with text, graphics, or other content while the substrate is in two-dimensional form. The substrate may be cut along the border lines 105 after printing is complete.

Personalized dimensional items are highly desirable, but expensive to produce, as the production must be done manually or with a support system that can be expensive or inefficient. Current structural printing systems implement a set of instructions and can mass-produce similar items, but the systems have limited ability to customize print jobs with structural features. These limitations can cause delays in assembly time as the system is reprogrammed or manually manipulated to change images and/or substrates.

Similarly, personalized documents are often intended to go to a single recipient. Single products or batches of products having personalized items must be closely monitored and tracked as the recipient's address for the personalized items may vary between each item. This may require a separate shipping invoice for each personalized item. These shipping invoices must be tracked with each personalized item as well. If the shipping invoice is lost or otherwise misplaced before the personalized item is packaged, the intended recipient addressing information may be lost as well, rendering the personalized item useless, or delaying the packaging process while the intended recipient information is determined.

SUMMARY

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this document is to be construed as an admission that the embodiments described in this document are not entitled to antedate such disclosure by virtue of prior invention. As used in this document, the term "comprising" means "including, but not limited to."

In one general respect, the embodiments disclose a method for producing a personalized dimensional document having a packaging label. The method includes receiving, at a printing device, a dimensional document configured to be assembled into a three-dimensional package; determining, at the printing device, a personalized object; printing, at the printing device, the personalized object on the dimensional document; and printing, at the printing device, a packaging label comprising addressing information for a recipient of the dimensional document, wherein the packaging label is removably affixed to the dimensional document.

In another general respect, the embodiments disclose a method for producing a personalized dimensional document having a packaging label. The method includes receiving, at a printing device, a dimensional document; determining, at the printing device, a personalized object; printing, at the printing device, the personalized object on the dimensional document; printing, at the printing device, a packaging label comprising addressing information for a recipient of the dimensional document, wherein the packaging label is removably affixed to the dimensional document; and assembling, by an assembly device, the dimensional document into a three-dimensional package.

In another general respect, the embodiment disclose a system for producing a personalized dimensional document having a packaging label, the system including a printing device. The printing device is configured to receive a dimensional document configured to be assembled into a three-dimensional package, determine a personalized object, print the personalized object on the dimensional document, and print a packaging label comprising addressing information for a recipient of the dimensional document, wherein the packaging label is removably affixed to the dimensional document.

DETAILED DESCRIPTION

For purposes of the discussion below, the term "assembly device" refers to one or more machines used to perform an operation on a dimensional document. Exemplary assembly devices include printers, die cutters, collators, creasing or scoring devices, glue application facilities, perforators, inserters, shrink wrappers and the like.

A "dimensional document" refers to a substrate made of, for example and without limitation, paper, cardboard, or other material to which, for example and without limitation, printed material, cut lines and/or score lines may be applied. A dimensional document is typically printed as a flat, but with several facets having boundaries formed by cut lines and/or score lines so that the document can be folded along the score lines to provide three-dimensional features or to produce a three-dimensional package.

A "personalized object" refers to one or user selected or created features printed on a dimensional document. Personalized objects may include, but are not limited to, personalized text, user submitted images, stock images, backgrounds, and other texts or images.

Figure 1:
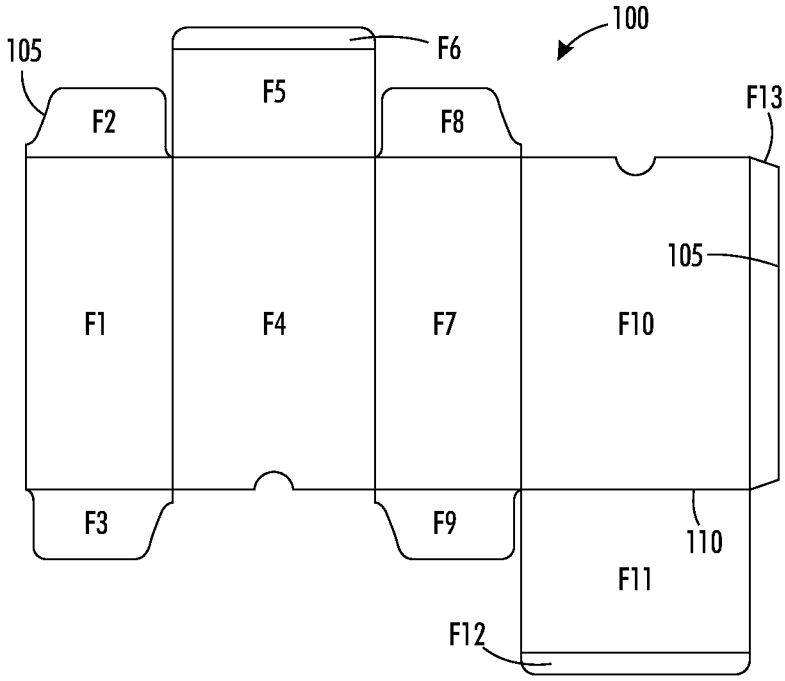
FIG. 1 PRIOR ART
FIG. 1 illustrates an exemplary foldable substrate structure.
Figure 2A:
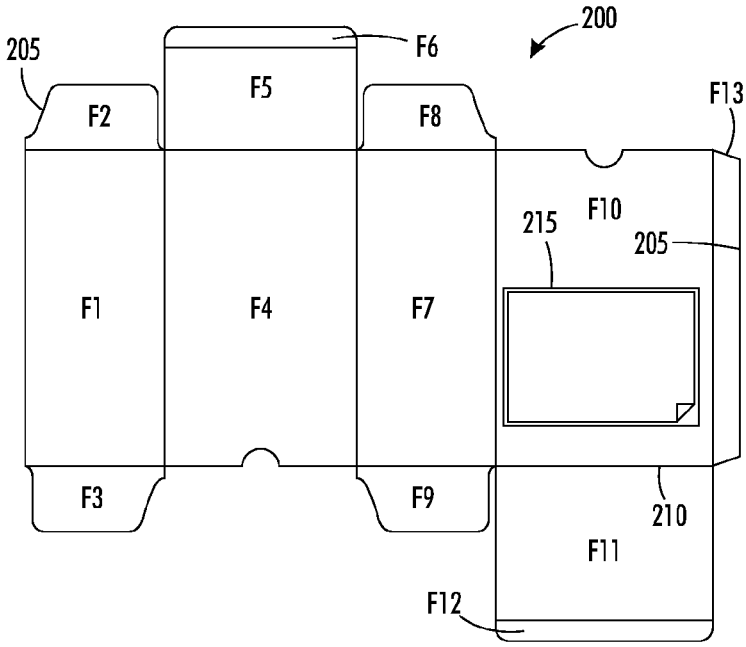
FIGS. 2A and 2B depict an exemplary personalized dimensional document having an addressing label according to an embodiment.
Figure 2B:
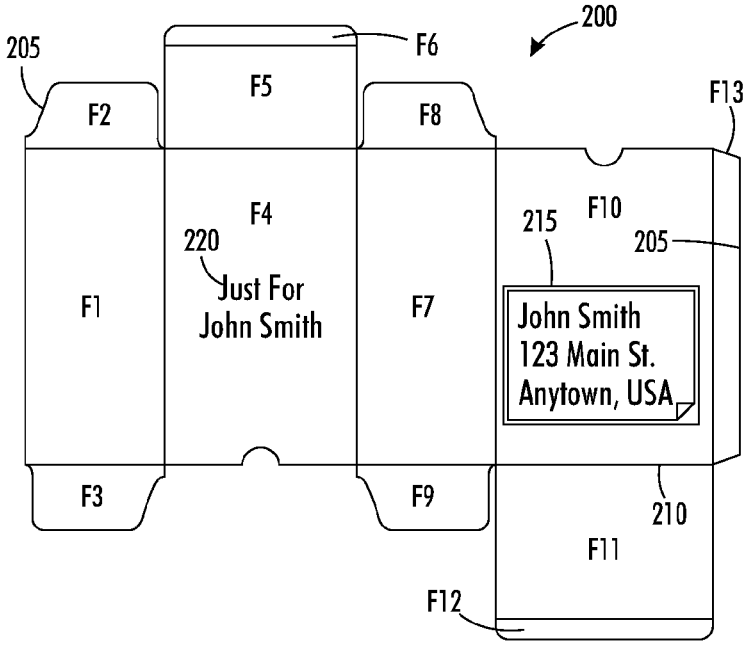

FIGS. 2A and 2B illustrates an exemplary personalized dimensional document 200 before it is folded into a three-dimensional structure. The dimensional document 200 may have various facets F1-F13 of varying shapes and sizes. The facets may be separated by fold lines 210 that may be created by scoring or ablating the substrate. The substrate shown may be folded into a three-dimensional box having a top facet F4; a bottom facet F10; side facets F1, F5, F7 and F11; and various flaps F2, F3, F6, F8, F9, F12 and F13. Any of the facets may be printed with, for example, text, graphics or other content while the substrate is in two-dimensional form. The substrate may be cut along the border lines 205 after printing is complete.

Additionally, as shown in FIG. 2A, the dimensional document 200 may include a packaging label 215. The packaging label 215 may be placed in a common area on all dimensional documents such that an assembly device can easily locate the packaging label and print any relevant packaging information on the label. Alternatively, the assembly device may include a printing device that prints a packaging label 215 for each dimensional document 200 and an applicator device that affixes the label at a point on the dimensional document that will not be obvious (e.g., the bottom or back face of the dimensional document). The packaging label 215 may be a standard mailing label, including a white substrate suitable for printing, removably affixed to a backing material via a reusable adhesive applied to the packaging label. The backing material may be printed with a design or pattern to match any background or design of the dimensional document 200. The backing material may be affixed to the dimensional document 200 via a non-removable adhesive. Similarly, the packaging label 215 may only include the white substrate removably affixed directly to the dimensional document 200 via a reusable adhesive applied to the packaging label.

As shown in FIG. 2B, the printing device may print the address of the recipient of the personalized dimensional document 200 onto the packaging label 215. Additionally, as shown in FIG. 2B, an object such as personalized text 220 may be printed on the dimensional document 200. Additional objects such as user submitted images, stock images, backgrounds, and other texts or images may be printed on the dimensional document 200 as well depending on a customer's preferences.

Figure 3:
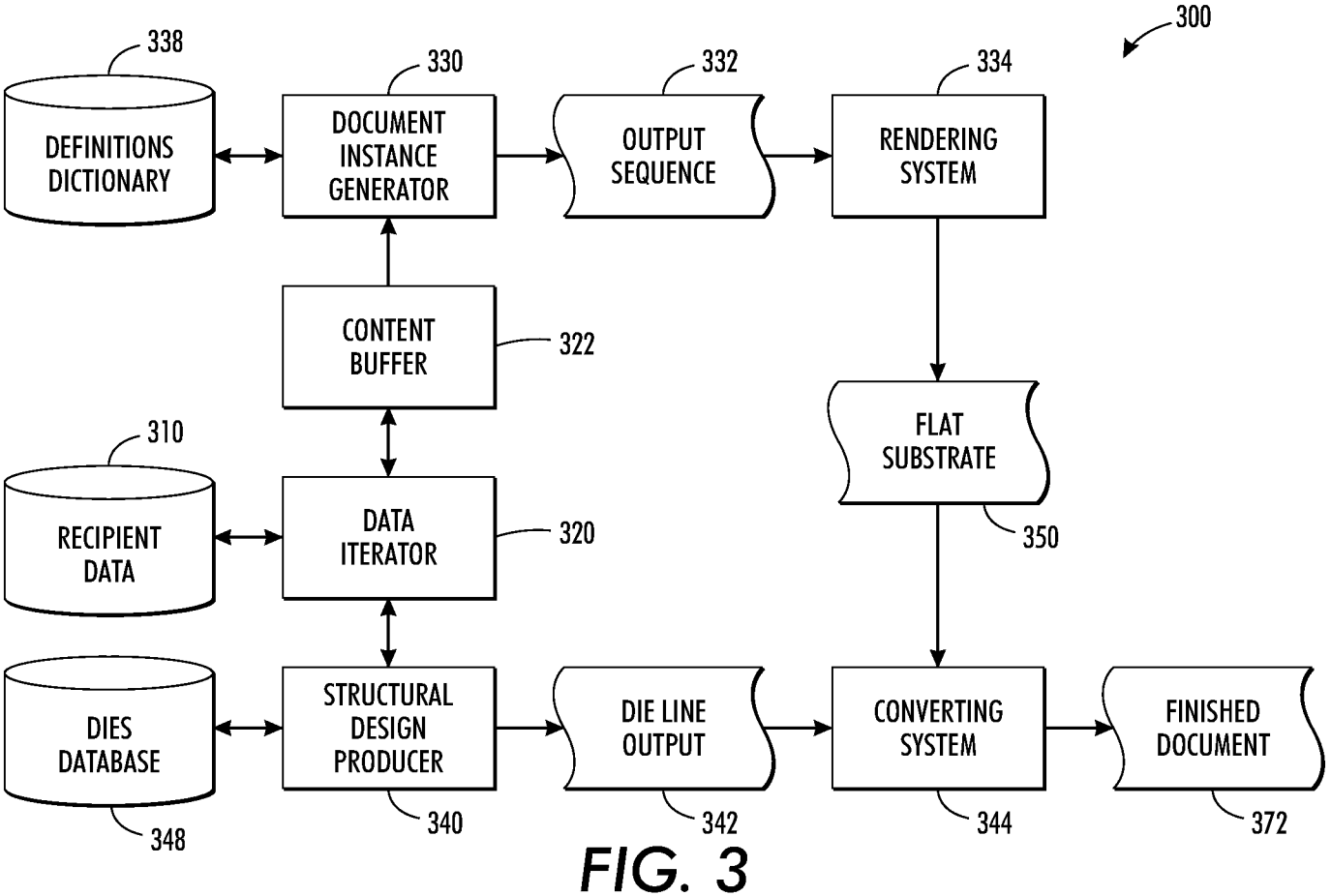
FIG. 3 is an exemplary system diagram of a printing system configured to produce a personalized dimensional document according to an embodiment.

FIG. 3 illustrates an exemplary system or assembly device 300 for producing a personalized dimensional document having a corresponding packaging label, such as packaging label 215 as shown in FIGS. 2A and 2B. A personalized dimensional document may include, for example, a three-dimensional package having personalized text or images intended for delivery to a specific recipient. As shown in FIG. 3, the system may include a memory 310 containing one or more recipient records. Each recipient record in the memory 310 may include data corresponding to one or more objects to be printed on a personalized dimensional document. Each object may represent an image or text, such as the personalized text 220 as shown in FIG. 2B. The recipient records may also include contact information and delivery details related to the recipient of the dimensional document.

A data iterator 320 may be a processor that is configured to select a recipient record from the memory 310 and send the information from the record to a document instance generator 330 and a structural design producer 340. Optionally, a content buffer 322 may hold the data before delivery to the document instance generator 330. The document instance generator 330 may be a processor that is configured to generate an output sequence 332 for rendering the personalized dimensional document as a printed document. The output sequence 332 may be generated in an object-oriented code language, such as the variable print specification (VPS) language, personalized print markup language (PPML), or portable document format (PDF). Optionally, the document instance generator 330 may access a definitions dictionary 338 which may contain reusable object names and definitions for the names, and the document instance generator 330 may use this information to generate the output sequence 332. The definitions database may include the code or an image format specifying the object appearance. The output sequence may be used by a rendering system 334 to print one or more objects from the output sequence onto a substrate to produce a customized flat substrate 350. The rendering system 334 includes a computing device and a document production device, such as a processor and printer, resepctively.

Referring back to FIG. 2B, an exemplary object printed on the dimensional document 200 may include any printed information, including but not limited to personalized text 220 (such as a greeting, a customized message, other text), custom graphics (such as an image of an item to be placed inside a custom package or a corporate logo), a background, or a unique identifier such as a bar code, hash sequence, serial number, or other similar identifier. The printed objects also may include one or more reference marks that a device may use to identify a position on the substrate. The device may use the identified position as a reference location for printing additional material or applying structural features such as fold lines, cut lines and/or score lines on the substrate. Additionally, an exemplary object may include a mailing address or other contact information for a recipient to be printed on packaging label 215.

Referring back to FIG. 3, the printed, flat substrate 350 may exit the rendering system 334 and be received by a converting system 344. A structural design producer 340 may also receive the recipient record from the memory 310 and use information in the recipient record specific to the dimensional document to generate a customized die line output code sequence 342. The customized die line output code sequence 342 may be in an object-oriented code language such as VPS, Virtual Reality Modeling Language (VRML), PPML, Adobe Illustrator (AI), or PDF.

In an embodiment, the structural design producer 340 is a processor that may be common with and part of the document instance generator 330. In an alternative embodiment, the structural design producer 340 is separate from the document instance generator 330. Optionally, the structural design producer 340 may access a dies database 348 which contains layout information for various dimensional document templates, and the structural design producer 340 may use this information to generate the die line sequence 342.

The converting system 344 may be an electromechanical device that applies cuts, creases, perforations, folds, and/or other structural features along the die lines. The converting system 344 receives the die line output code sequence 342 and uses the code sequence to identify positions to apply cuts, perforations, punches, folds, slits, inserts, adhesive coatings, indentations and/or other structural features, thus yielding a finished personalized dimensional document 372. The converting system 344 may perform the finishing steps using any known or hereafter developed methods. For example, the converting system 344 may use the position of the packaging label to locate positions on the substrate and apply die lines based on specific data found in a recipient data file and/or the die line output code sequence. Alternatively, the converting system 344 may use edge detection techniques to apply a cut or perforation around an image edge. In another embodiment, the converting system 344 may use die line files selected based on a unique identifier printed on the substrate, or other methods. Additional and/or alternate methods may be used within the scope of this disclosure.

The system described above can thus produce multiple, personalized dimensional documents, packages or other substrates for each recipient record in the memory 310. In some embodiments, the system can concurrently launch multiple production paths to concurrently generate individual parts of a complex personalized dimensional document.

Figure 4:
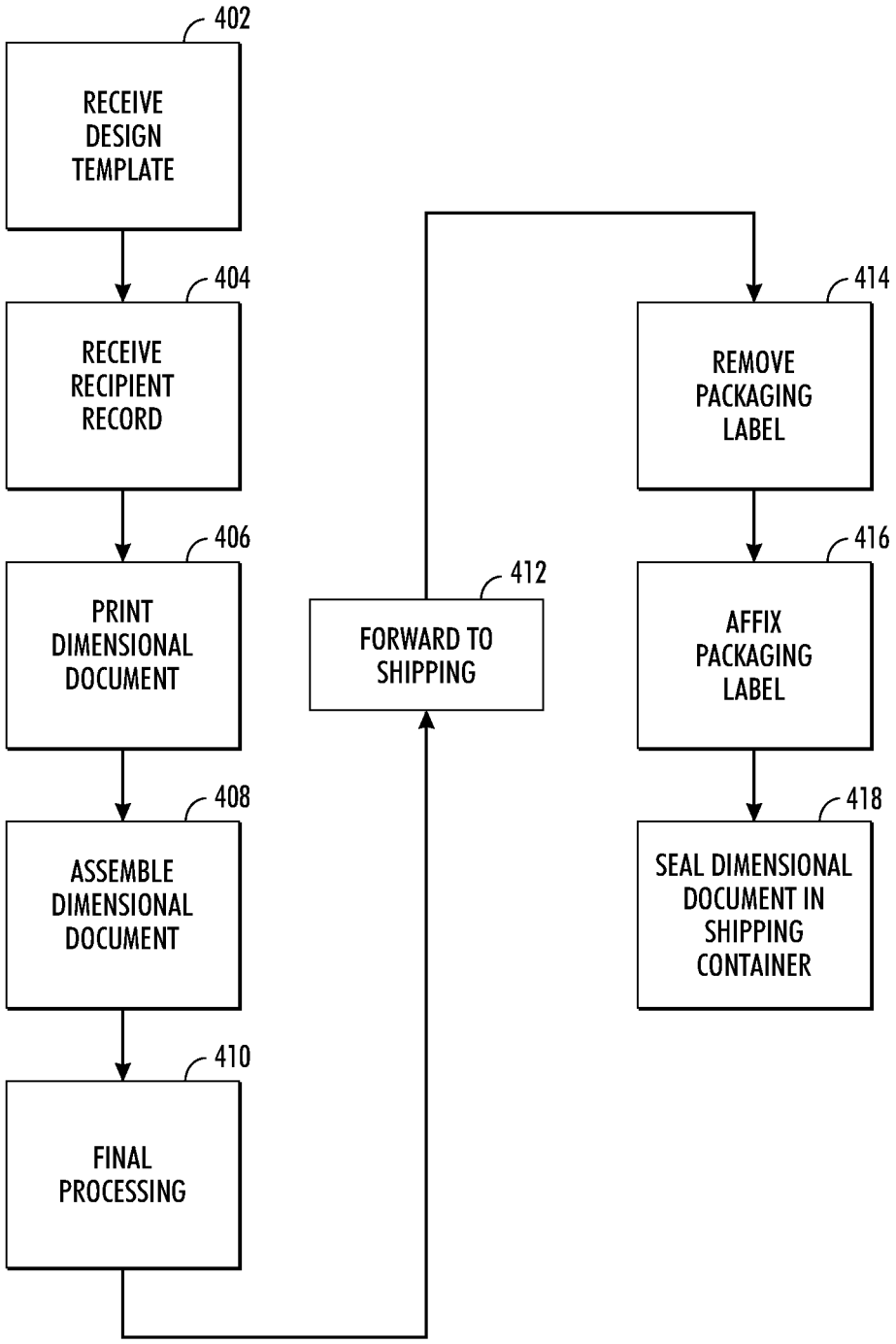
FIG. 4 is a flowchart illustrating exemplary steps of a method of producing a three-dimensional substrate having an addressing label according to an embodiment.

FIG. 4 illustrates a process flow illustrating an exemplary method of generating a dimensional document that is printed and personalized and has a removable packaging label using a system such as that described above in reference to FIG. 3. Referring to FIG. 4, a method of printing a personalized dimensional document may include receiving 402 at an assembly device, such as assembly device 300, a structural design template for a dimensional document to be printed. A user may select the structural design template from a set of standard templates, such as various boxes, folding greeting cards or other dimensional documents. The assembly device may further receive 404 a recipient record from a recipient database or list. The recipient record may include various data related to the dimensional document to be produced, such as any personalized content to include (e.g., personalized text 220) and/or the address of a recipient for printing on a packaging label (e.g., packaging label 215). The assembly device may use the information contained in the recipient record to print 406 one or more objects on the dimensional document. Similarly, the assembly device may print 406 the recipient's address on a packaging label based upon any addressing information contained in the recipient record. As discussed above, the packaging label may be pre-applied to the dimensional document before processing, or the assembly device may print 406 an individual packaging label and apply the label to the dimensional document. Alternatively, an applicator device may receive the packaging label from a printing device and apply the packaging label to the dimensional document.

The assembly device may assemble 408 the printed dimensional document into its three-dimensional shape. Assembly 408 may include cutting, scoring, folding, and fastening the dimensional document into a completed three-dimensional package. For example, a dimensional document such as dimensional document 200 may be cut along border lines 205, scored to define the various facets F1-F13, and folded along fold lines 210 to produce a three-dimensional package.

Final processing 410, such as filling the dimensional document with materials to be shipped, may be performed on the dimensional document and the dimensional document may be sealed. The dimensional document may be forwarded 412 to a shipping department where the packing label may be removed 414 and affixed 416 to a shipping container. The dimensional document may be sealed 418 within the shipping container, which is further processed for delivery to its recipient.

This process may be repeated for a second recipient record and corresponding second dimensional document, as well as additional records and substrates. If so, the assembly device repeats the above discussed process for each recipient record, printing a personalized dimensional document with a corresponding packaging label for each recipient record.

It should be noted the process shown in FIG. 4, specifically the order of the steps taken, is shown by way of example only. For example, receiving 402 the design template and receiving 404 the recipient record may be performed simultaneously, or in an alternate order. Additionally, the process is not limited to the steps shown in FIG. 4. For example, the assembly 408 of the dimensional document may be broken into several additional steps.

Figure 5:
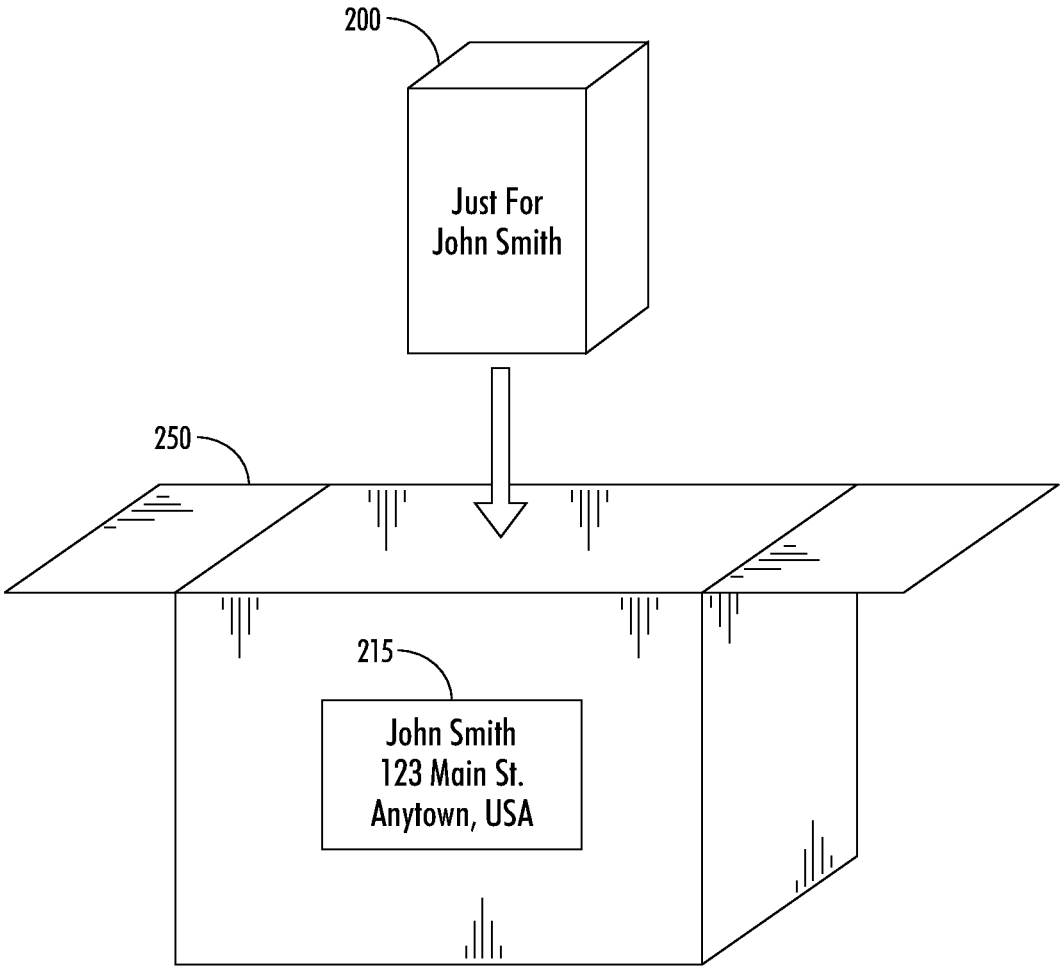
FIG. 5 is an exemplary shipping container for a personalized foldable substrate structure according to an embodiment.

FIG. 5 illustrates an exemplary shipping container 250 for shipping the dimensional document 200. After the dimensional document 200 is printed, folder, and filled with one or more items to be delivered, the packaging label 215 may be removed from the dimensional document and placed on the shipping container 250. The dimensional document 200 may be placed inside the shipping container 250 along with any protective packing materials (e.g., foam, paper, bubble wrap, plastic wrap, or any other protective packing materials), sealed within the shipping container, and shipped to the address indicated on the addressing label 215.

It should be noted that shipping container 250 is illustrated as a box for exemplary purposes only. The dimensions and shape of the shipping container 250 may vary depending on the size and shape of the dimensional document 200. For example, the shipping container 250 may be a standard corrugated box, a padded envelope, a shipping tube, or any other container appropriately sized and shaped to ship the dimensional document 200.

Based on the teachings disclosed herein, the production and packaging of personalized dimensional documents may be streamlined and simplified, and common problems associated with standard shipping methods may be avoided. For example, a company may produce personalized boxes of candy with the recipient's name on the top of each box. Conventionally, in order to reliably produce each personalized box of candy, and make certain that the box is delivered to the correct recipient address, an invoice must be attached or otherwise associated with the box until the box of candy is ready to ship. Then, shipping information must be extracted from the invoice, incorporated onto a shipping container into which the box of candy is to be packed and shipped. If at any point the invoice is lost or otherwise separated from the personalized box, the intended recipient for the personalized box may be lost and processing of the personalized box may be halted until the address of the intended recipient is determined. In a worst case, the personalized box may be destroyed or otherwise discarded as unusable.

In contrast, based on the teachings disclosed herein, the need to keep a shipping invoice with the personalized box of candy until shipping is eliminated. Rather, when the personalized message or name is printed on the box of candy, a packaging label is also printed somewhere on the box. For example, the packaging label may be placed on the bottom of the box of candy, thereby remaining relatively unobtrusive to any designs on the box of candy. Conversely, the backing of the label may be printed to have a similar pattern to any design or background of the box of candy. Thus, once the printed label is removed, the remaining backing blends into the design or background of the box.

Once the packaging label is printed with the recipient's address, the label may be removed and placed on a shipping container into which the personalized box of candy is placed. By affixing the packaging label to the personalized box of candy, the risk of losing the invoice is eliminated and the shipping process is simplified.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. A method for producing a personalized dimensional document having a packaging label comprising:

receiving, at a printing device, a dimensional document configured to be assembled into a three-dimensional package, the dimensional document comprising a plurality of facets including at least a top facet, a bottom facet, and a plurality of side facets;

determining, at the printing device, a personalized object;

printing, at the printing device, the personalized object on at least one of the top facet or one of the plurality of side facets of the dimensional document; and printing, at the printing device, a packaging label comprising addressing information for a recipient of the dimensional document; and removably affixing, by an applicator device, the printed packaging label to the dimensional document such that an area the packaging label is affixed to is not visible when the assembled three-dimensional package is placed in a shipping container.

2. The method of claim 1, further comprising applying, by an assembly device, at least one of a crease, fold, cut, insert, slit, adhesive, or perforation to the dimensional document prior to the dimensional document being assembled into a three-dimensional package.

3. The method of claim 1, further comprising receiving, by the assembly device, a recipient record prior to determining the personalized object.

4. The method of claim 3, wherein the recipient record comprises:

the personalized object to be printed on the dimensional document; and the addressing information.

5. The method of claim 3, further comprising using the recipient record to identify content of the personalized object and content of the packaging label, wherein printing the packaging label comprises printing the identified content of the packaging label.

6. The method of claim 1, wherein the personalized object comprises at least one of a text greeting or an image.

7. The method of claim 1, wherein the printed packaging label is removably affixed to the bottom facet of the dimensional document.

8. The method of claim 1, further comprising:

removing the packaging label from the dimensional document;

affixing the printed label to a shipping container; and placing the dimensional document into the shipping container.

9. A method for producing a personalized dimensional document having a packaging label comprising:

receiving, at a printing device, a dimensional document, the dimensional document comprising a plurality of facets including at least a top facet, a bottom facet, and a plurality of side facets;

determining, at the printing device, a personalized object;

printing, at the printing device, the personalized object on at least one of the top facet or one of the plurality of side facets of the dimensional document;

printing, at the printing device, a packaging label comprising addressing information for a recipient of the dimensional document;

removably affixing, by an applicator device, the printed packaging label to the dimensional document such that an area the packaging label is affixed to is not visible when the assembled three-dimensional package is placed in a shipping container; and assembling, by an assembly device, the dimensional document into a three-dimensional package.

10. The method of claim 9, further comprising applying, by the assembly device, at least one of a crease, fold, cut, insert, slit, adhesive, or perforation to the dimensional document prior to assembling the dimensional document into a three-dimensional package.

11. The method of claim 9, further comprising receiving, by the printing device, a recipient record prior to determining the personalized object.

12. The method of claim 11, wherein the recipient record comprises:

the personalized object to be printed on the dimensional document; and the addressing information.

13. The method of claim 9, wherein the personalized object comprises at least one of a text greeting or an image.

14. The method of claim 9, wherein the printed packaging label is removably affixed to the bottom facet of the dimensional document.

15. A system for producing a personalized dimensional document having a packaging label comprising:

a printing device configured to:

receive a dimensional document configured to be assembled into a three-dimensional package, the dimensional document comprising a plurality of facets including at least a top facet, a bottom facet, and a plurality of side facets, determine a personalized object;

print the personalized object on at least one of the top facet or one of the plurality of side facets of the dimensional document, and print a packaging label comprising addressing information for a recipient of the dimensional document; and an applicator device configured to removably affix the printed packaging label to the dimensional document such that an area the packaging label is affixed to is not visible when the assembled three-dimensional package is placed in a shipping container.

16. The system of claim 15, further comprising an assembly device operably connected to the printing device and configured to apply at least one of a crease, fold, cut, insert, slit, adhesive, or perforation to the dimensional document prior to the dimensional document being assembled into a three-dimensional package.

17. The system of claim 15, wherein the printing device is further configured to receive a recipient record prior to determining the personalized object.

18. The system of claim 17, wherein the recipient record comprises:

the personalized object to be printed on the dimensional document; and the addressing information.

19. The system of claim 15, wherein the personalized object comprises at least one of a text greeting or an image.

20. The system of claim 15, wherein the applicator device is further configured to removably affix the printed packaging label to the bottom facet of the dimensional document.

* * * * *